US005122243A

United States Patent [19]

Hall

[11] Patent Number: 5,122,243

[45] Date of Patent: Jun. 16, 1992

[54] LITHOGRAPHIC PRINTING PLATES COMPRISING AN ALUMINUM SUPPORT GRAINED IN A TWO STAGE-ELECTROLYTIC PROCESS

[75] Inventor: Susan C. Hall, Fort Collins, Colo.

[73] Assignee: Eastman Kodak Company, Rochester, N.Y.

[21] Appl. No.: 733,571

[22] Filed: Jul. 22, 1991

[51] Int. Cl.[5] ..... C25F 3/04

[52] U.S. Cl. ..... 204/129.35; 204/129.4; 204/129.75; 156/665; 205/214

[58] Field of Search ..... 204/129.35, 129.4, 129.75; 156/665; 205/214

[56] References Cited

U.S. PATENT DOCUMENTS

| | | | |
|---|---|---|---|
| 3,755,116 | 8/1973 | Terai et al. | 204/129.95 |
| 4,087,341 | 5/1978 | Takahashi et al. | 204/129.43 |
| 4,213,835 | 7/1980 | Fickelscher | 204/129.75 |
| 4,272,342 | 6/1981 | Oda et al. | 204/129.75 |
| 4,518,471 | 5/1985 | Arora | 204/129.75 |
| 4,548,683 | 10/1985 | Huang et al. | 204/129.4 |
| 4,721,552 | 1/1988 | Huang et al. | 204/129.75 |
| 4,735,696 | 4/1988 | Huang et al. | 204/129.43 |
| 4,786,381 | 11/1988 | Mohr et al. | 204/129.75 |
| 5,041,198 | 8/1991 | Hausmann | 204/129.75 |

*Primary Examiner*—John Niebling
*Assistant Examiner*—Kishor Mayekar
*Attorney, Agent, or Firm*—Alfred P. Lorenzo

[57] ABSTRACT

Improved lithographic printing plates comprise an aluminum support which has been grained in a novel two-stage electrolytic graining process and a radiation-sensitive layer capable of forming a lithographic printing surface. The aluminum support is subjected to an electric current while immersed in an acidic electrolyte solution, such as a solution comprised of hydrochloric acid and aluminum chloride. Current density in the first stage of the process is at least as great and preferably substantially greater than in the second stage, while both treatment time and current consumption in the first stage are less than in the second stage. The process provides a fine uniform grain that is essentially free of pits. Any radiation-sensitive layer is suitable, which after exposure and any necessary developing and/or fixing provides an area in imagewise distribution which can be used for printing.

26 Claims, No Drawings

LITHOGRAPHIC PRINTING PLATES COMPRISING AN ALUMINUM SUPPORT GRAINED IN A TWO STAGE-ELECTROLYTIC PROCESS

CROSS-REFERENCE TO RELATED APPLICATIONS

Copending, commonly-assigned, U.S. Pat. application Ser. No. 07/733,569 filed Jul. 22, 1991, "Two-Stage Process For Electrolytic Graining of Aluminum", by Susan C. Hall relates to the process utilized in electrolytic graining of the aluminum support employed in the lithographic printing plates of this invention.

FIELD OF THE INVENTION

This invention relates in general to lithographic printing and in particular to improved lithographic printing plates having an aluminum support which has been electrolytically grained. More specifically, this invention relates to improved lithographic printing plates having an aluminum support that has been electrolytically grained by a novel two-stage process that provides a fine uniform grain that is essentially free of pits.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described, for example, in U.S. Pat. Nos. 3,755,116, 3,887,447, 3,935,080, 4,087,341, 4,201,836, 4,272,342, 4,294,672, 4,301,229, 4,396,468, 4,427,500, 4,468,295, 4,476,006, 4,482,434, 4,545,875, 4,548,683, 4,564,429, 4,581,996, 4,618,405, 4,735,696, 4,897,168 and 4,919,774.

In an electrolytic graining process, the aluminum is treated, so as to increase its surface area and create a specific surface structure, by passing an electric current—usually an alternating electric current—from an electrode through an acid electrolyte to the aluminum. Typically, the aluminum that is conveyed through the electrolyte solution is in the form of a thin continuous web that may have a width of as much as two or more meters. It is desirable to grain the surface with a high efficiency in regard to both electric power and chemical consumption, while at the same time achieving proper grain morphology without excessive formation of adhering reaction by-products, commonly referred to as "smut". The presence of smut can necessitate an aggressive etch treatment, following the graining operation, which can further modify the surface in an unwanted manner. It is therefore highly desirable to operate the process in such a way that a minimal amount of smut is formed, and that which is formed is loosely bound and easily removed.

In carrying out electrolytic graining of aluminum, it is typical to utilize nitric or hydrochloric acid in admixture with the respective aluminum salt thereof. Other acids and many other types of chemical agents are also known for use in electrolytic graining baths. Electrodes, most commonly formed of graphite, are positioned to oppose the aluminum web at a distance ranging from about one-half centimeter to several centimeters. Either single phase or three phase alternating current is passed through the electrolyte so that at the interface between the solution and the aluminum, a displacement reaction occurs whereby aluminum is oxidized to form either the chloride or nitrate salt which is soluble in the solution. By removing aluminum with the use of an electric current, a specific surface structure is obtained. Parameters such as temperature, electrolyte concentration, flow rates and electrode spacing are important in determining the characteristics of the surface structure produced.

Most of the known electrolytic graining processes involve the use of uniform current density along the web. However, Oda et al in U.S. Pat. No. 4,272,342 propose a method of electrolytic graining of aluminum in which an alternating current is passed through the aluminum in such a way that $$Q_1 > Q_2 < Q_3$$

wherein $Q_1$, $Q_2$, and $Q_3$ represent, respectively, the quantity of electricity per unit area of application during the first one-third period, the intermediate one-third period and the final one-third period of the total electrolytic graining time. This method of control of current density distribution is said to reduce the total quantity of electricity required and to provide improvement in the quality of grain structure realized. However, there is still a critical need in the art for an improved electrolytic graining process which will provide a grain structure that is more ideally suited to the requirements of lithographic printing plates.

It is toward the objective of providing new and improved lithographic printing plates, having an aluminum support with a more uniform electrolytically grained surface, that the present invention is directed.

SUMMARY OF THE INVENTION

The lithographic printing plates of this invention comprise an electrolytically grained aluminum support having thereon at least one radiation-sensitive layer capable of forming a lithographic printing surface. Electrolytic graining of the aluminum support is carried out by a two-stage process—i.e., a process employing first and second stages in which treatment conditions are different. In this process, the aluminum is immersed in an acidic electrolyte solution while it is subjected to an alternating electric current, and the application of the alternating electric current is controlled so that $D_1:D_2$ is in the range of from about 1:1 to about 7:1, $t_1:t_2$ is in the range of from about 1:2 to about 1:15, $Q_1$ is less than $Q_2$, and the total current consumption ($Q=Q_1+Q_2$) is in the range of from about 200 to about 5,000 coulombs/dm$^2$; wherein $D_1$ and $D_2$ respectively represent current density in amps/dm$^2$ in the first and second stages, $t_1$ and $t_2$ respectively represent treatment time in seconds in the first and second stages, and $Q_1$ and $Q_2$ respectively represent current consumption in coulombs/dm$^2$ in the first and second stages.

In the two-stage process described herein, current density is at least as great and preferably substantially greater in the first stage than in the second stage, whereas time is longer in the second stage than in the first stage. Current density and time in each stage must not only satisfy the ratios specified above, but must be so selected that $Q_1$ (which is equal to the product of $D_1$ and $t_1$) is less than $Q_2$ (which is equal to the product of $D_2$ and $t_2$) and that the sum of $Q_1$ and $Q_2$ is in the range of from about 200 to about 5,000 coulombs/dm$^2$, as specified hereinabove.

The process described herein provides much more uniform grain than that provided by the process of U.S. Pat. No. 4,272,342, and thereby provides a superior lithographic plate. It is also a much simpler and more easily controlled process in that it is a two-stage process, while the process of U.S. Pat. No. 4,272,342 is a three-stage process.

DESCRIPTION OF THE PREFERRED EMBODIMENTS

The term "aluminum" as used herein is intended, as the context requires, to include both pure aluminum and aluminum alloys, which are capable of being grained electrolytically. Suitable alloys of aluminum include alloys containing minor amounts of any of silicon, iron, copper, manganese, magnesium, zinc, titanium, chromium, nickel and the like.

Prior to electrolytic graining, the surface of the aluminum is cleaned to remove oil, dirt and grease therefrom. Suitable solvents and/or caustic solutions for carrying out such cleaning are well known in the art.

The two-stage electrolytic graining process described herein is a process which can be carried out in a batch, semi-continuous or continuous manner. Thus, for example, in a batch operation, the aluminum article can be immersed in a suitable electrolyte solution and an alternating electric current, at an appropriate current density, can be supplied for a sufficient time to complete stage one. The current density can then be decreased by appropriate control of the voltage applied and the appropriate time can be selected to complete stage two. Typically, the process is a continuous one in which aluminum in the form of a continuous web is unwound from a roll and passed successively through the first and second stages of the process, whereupon it is subjected to further treatment such as an anodization process. Following anodization and perhaps other treatment such as hydrophilization, the aluminum can be rewound or it can be subjected to an in-line coating process in which one or more radiation-sensitive layers are coated thereon to produce a lithographic printing plate. However, in its broadest context, the process described herein is one in which aluminum articles of any shape or form are subjected in any suitable manner to the two-stage treatment described herein.

The two-stage electrolytic graining process described herein preferably utilizes alternating electric current. Either single phase alternating current or three phase alternating current can be utilized, and alternating current of any suitable wave form can be usefully employed. Direct current can be used, if desired, but it typically provides a less uniform grain.

The two-stage electrolytic graining process described herein provides a remarkably improved grained surface. In particular, it provides a fine uniform grain that is essentially free of pits. The grained surface is especially well adapted for use as a support for lithographic printing plates.

In the process described herein, the total current consumption, i.e., the sum of the current consumed in both stages, is in the range of from about 200 to about 5,000 coulombs/dm$^2$ of aluminum surface being treated, and preferably in the range of from about 1,000 to about 3,000 coulombs/dm$^2$. Current is controlled so that $D_1:D_2$ is in the range of from about 1:1 to about 7:1; more preferably in the range of from about 1.2:1 to about 5:1; and most preferably in the range of from about 2:1 to about 4:1; where $D_1$ and $D_2$ respectively represent current density in amps/dm$^2$ in the first and second stages of the two-stage process. The time for which the aluminum is treated is selected so that $t_1:t_2$ is in the range of from about 1:2 to about 1:15, more preferably in the range of from about 1:3 to about 1:10; and most preferably in the range of from about 1:4 to about 1:8; where $t_1$ and $t_2$ respectively represent treatment time in seconds in the first and second stages of the two-stage process. The term "treatment time", as used herein, refers to the time that the aluminum is immersed in the electrolyte while disposed opposite the electrode from which it receives the current. $Q_1$, which is the product of $D_1$ and $t_1$ and represents current consumption in coulombs/dm$^2$ is less than $Q_2$, which is the product of $D_2$ and $t_2$.

In the preferred process, the first stage employs much higher current density and much shorter treatment time, and the second stage employs much lower current density but much longer treatment time.

In a batch process, the treatment time in each stage is the time that the aluminum article being treated is allowed to remain immersed in the electrolyte solution, while electric current is applied thereto. In a continuous process, the time in each stage is dependent on the length of the stage and the speed at which the aluminum web or other aluminum article is advanced therethrough. Thus, a web travelling at a speed of one hundred meters per minute through a stage that is twenty meters long would be subjected to a treatment time of 12 seconds.

In the two-stage process described herein, the first and second stages can be represented by different tanks, or by separate compartments of a single tank, or by zones within a single tank whose length is defined by the electrode or electrodes characterizing that stage.

The independent variables which are controlled in the process described herein are time and current density. Voltage is a dependent variable. The voltage employed—which is typically in the range of from about 5 to about 50 volts—depends on the resistance which in turn depends on such factors as electrolyte composition, electrode spacing, degree of agitation, and so forth. Typically, the spacing between the electrodes and the aluminum web is in the range of 1 to 2 centimeters. Preferred current densities for the first stage are in the range of from about 50 to about 100 amps/dm$^2$, while preferred current densities for the second stage are in the range of from about 15 to about 40 amps/dm$^2$. Preferred treatment times for the first stage are in the range of from about 3 to about 10 seconds, while preferred treatment times for the second stage are in the range of from about 20 to about 50 seconds.

The acidic electrolyte solution used in the electrolytic graining process can be any electrolyte solution known to be useful in the art. Typical solutions include nitric acid in admixture with aluminum nitrate and hydrochloric acid in admixture with aluminum chloride.

In the two-stage process described herein, the acidic electrolyte solution can be maintained at any suitable temperature. Typical temperatures are in the range of from about 10° C. to about 75° C., and more preferably in the range of from about 20° C. to about 50° C.

A preferred electrolyte solution is a solution comprising hydrochloric acid and aluminum chloride. Typical concentrations for the hydrochloric acid are in the range of from about 0.1 grams per liter to about 30 grams per liter, more preferably from about 1 gram per liter to about 20 grams per liter, and most preferably from about 5 grams per liter to about 15 grams per liter Typical concentrations for the aluminum chloride are from about 1 gram per liter to about 50 grams per liter, more preferably from about 2 grams per liter to about 35 grams per liter, and most preferably from about 4 grams per liter to about 25 grams per liter.

The type and concentration of the electrolyte solution and the temperature are advantageously, but not necessarily, the same in both stages of the process.

As indicated above, the preferred electrolyte solution for use in the process is a solution containing hydrochloric acid and aluminum chloride. Incorporation of either boric acid or phosphoric acid or both in this electrolyte solution is optional, but preferred. Boric acid and phosphoric acid both act as corrosion inhibitors and serve to provide finer grain structure when utilized in such electrolyte solutions.

Boric acid is advantageously employed in an amount of from about 0.5 grams per liter up to its saturation point, more preferably in an amount of from about 3 grams per liter to about 13 grams per liter, and most preferably in an amount of from about 5 grams per liter to about 10 grams per liter. Phosphoric acid is advantageously employed in an amount of from about 1 gram per liter to about 35 grams per liter, more preferably in an amount of from about 5 grams per liter to about 20 grams per liter, and most preferably in an amount of from about 7.5 grams per liter to about 15 grams per liter.

Following the two-stage electrolytic graining process described herein, the aluminum can be etched with a mild caustic solution to brighten the surface and then desmutted by treatment with a suitable acid such as nitric acid or sulfuric acid.

In the manufacture of lithographic printing plates, the electrolytic graining process is typically followed by an anodizing process, utilizing an acid such as sulfuric or phosphoric acid, and the anodizing process is typically followed by a process which renders the surface hydrophilic such as a process of thermal silication or electrosilication. The anodization step serves to provide an anodic oxide layer and is preferably controlled to create a layer of at least 0.3 g/m$^2$. Processes for anodizing aluminum to form an anodic oxide coating and then hydrophilizing the anodized surface by techniques such as silication are very well known in the art, and need not be further described herein.

The two-stage electrolytic graining process described herein is particularly advantageous for preparing aluminum supports for use in lithographic printing plates. Such plates comprise at least one radiation-sensitive layer overlying the support. They can be either negative-working or positive-working.

A wide variety of radiation-sensitive materials suitable for forming images for use in the lithographic printing process are known. Any radiation-sensitive layer is suitable, which after exposure and any necessary developing and/or fixing provides an area in imagewise distribution which can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Radiation-sensitive materials useful in lithographic printing plates include silver halide emulsions; quinone diazides (polymeric and non-polymeric), as described in U.S. Pat. No. 4,141,733 (issued Feb. 27, 1979 to Guild) and references noted therein; light sensitive polycarbonates, as described in U.S. Pat. No. 3,511,611 (issued May 12, 1970 to Rauner et al) and references noted therein; diazonium salts, diazo resins, cinnamal-malonic acids and functional equivalents thereof and others described in U.S. Pat. No. 3,342,601 (issued Sep. 19, 1967 to Houle et al) and references noted therein; and light sensitive polyesters, polycarbonates and polysulfonates as described in U.S. Pat. No. 4,139,390 (issued Feb. 13, 1979 to Rauner et al) and references noted therein.

A particularly important class of negative-working lithographic printing plates are those based on the use of diazo resins. The radiation-sensitive layer is typically comprised of the diazo resin, a polymeric binder and other ingredients such as colorants, stabilizers, exposure indicators, surfactants and the like. Particularly useful diazo resins include, for example, the condensation product of p-diazo diphenyl amine and paraformaldehyde, the condensation product of 3-methoxy-4-diazo diphenylamine and paraformaldehyde, and the diazo resins of U.S. Pat. Nos. 3,679,419, 3,849,392 and 3,867,147. Particularly useful polymeric binders for use with such diazo resins are acetal polymers as described, for example, in U.S. Pat. Nos. 4,652,604, 4,741,985 and 4,940,646.

A second particularly important class of negative-working lithographic printing plates are those based on the use of radiation-sensitive photocrosslinkable polymers. Photocrosslinkable polymers which are particularly useful for this purpose are those containing the photosensitive group —CH=CH—CO— as an integral part of the polymer backbone, especially the p-phenylene diacrylate polyesters. These polymers are described, for example, in U.S. Pat. Nos. 3,030,208, 3,622,320, 3,702,765 and 3,929,489. A typical example of such a photocrosslinkable polymer is the polyester prepared from diethyl p-phenylenediacrylate and 1,4-bis(β-hydroxyethoxy)cyclohexane, which is comprised of recurring units of the formula:

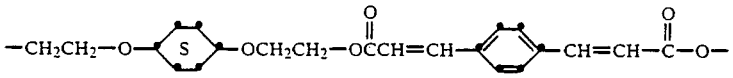

Other particularly useful polymers of this type are those which incorporate ionic moieties derived from monomers such as dimethyl-3,3'-[(sodioimino)disulfonyl]-dibenzoate and dimethyl-5-sodiosulfoisophthalate. Examples of such polymers include poly[1,4-cyclohexylene-bis (oxyethylene)-p-phenylenediacrylate]-co-3,3'-[sodioimino)disulfonyl]dibenzoate and poly[1,4-cyclohexylene-bis (oxyethylene)-p-phenylenediacrylate]-co-3,3'-[sodioimino)disulfonyl]dibenzoate-co-3-hydroxyisophthalate.

A third particularly important class of negative-working lithographic printing plates are the so-called "dual layer" plates. In this type of lithographic printing plate, a radiation-sensitive layer containing a diazo resin is coated over an anodized aluminum support and a radiation-sensitive layer containing a photocrosslinkable polymer is coated over the layer containing the diazo resin. Such dual layer plates are described, for example, in British Patent No. 1 274 017. They are advantageous in that radiation-sensitive layers containing diazo resins adhere much more strongly to most anodized aluminum supports than do radiation-sensitive layers containing photocrosslinkable polymers Thus, the enhanced performance provided by photocrosslinkable polymers is achieved without sacrificing the excellent adhesive properties of diazo resin compositions.

The invention is further illustrated by the following examples of its practice In these examples, three different types of aluminum were used, namely 1050 alloy, 3103 alloy and 5XXX alloy. The 1050 alloy contains a minimum of 99.50% aluminum and minor amounts of silicon, iron, copper, manganese, magnesium, zinc and titanium. The 3103 alloy contains approximately 96.5% aluminum and minor amounts of silicon, iron, copper, manganese, magnesium, chromium and zinc. The 5XXX alloy contains approximately 98.5% aluminum and minor amounts of silicon, iron, copper and magnesium, as described, for example, in U.S. Pat. No. 4,818,300.

The objective of this invention is to provide an improved lithographic printing plate in which the surface of the aluminum support has a fine uniform grain that is free of pits. In order to characterize the surface, measurements were made for the following parameters, all of which are defined in ANSI/ASME Standard B46.1 - 1985 for surface texture:

$R_a$, which is the roughness average and is also known as the center line arithmetic average, is the arithmetic average of the absolute values of the measured profile height deviations taken within the sampling length and measured from the graphical center line.

$R_q$, which is the root-mean-square roughness, is the root-mean-square deviation from the center line.

$R_z$, which is the ten-point height, is the average distance between the five highest peaks and the five deepest valleys within the sampling length measured from a line parallel to the mean line and not crossing the profile.

For lithographic printing plates, all of the above parameters characterizing the grained aluminum surface are important. The smaller the value of $R_a$, the finer the grain. The smaller the value of $R_z$, the greater the freedom from pits. Generally speaking, an $R_a$ value of less than 0.5 and an $R_z$ value of less than 6 is indicative of a three-dimensional structure that provides excellent ink/water balance. Ideally, the value of $R_q/R_a$ should be one, since this would represent a perfectly uniform surface. However, this ideal is not attainable, and for lithographic printing plate supports, values of $R_q/R_a$ of 1.30 or less are considered to provide excellent performance.

When all other factors are the same, for example the type and concentration of electrolyte, the bath temperature, the electrode spacing, and so forth, a lower value for $R_q/R_a$ and thus a more uniform grain is achieved when $D_1$, $D_2$, $t_1$, $t_2$, $Q_1$ and $Q_2$ meet the relationships specified herein.

In the examples which follow, the optical density was measured by means of a reflection densitometer. The value of the optical density is indicative of the amount of smut on the grained surface. The lower the optical density the lower the amount of smut. A white surface would typically have an optical density of about 0.1 or 0.2 while a dark gray or black surface would have an optical density of about 1.3.

EXAMPLES 1-30

An aluminum web having a thickness of 0.20 millimeters was subjected to a continuous two-stage electrolytic graining process in accordance with this invention. In each of Examples 1 to 30, the aluminum was 1050 alloy, except as otherwise indicated. The electrolyte solution contained hydrochloric acid and aluminum chloride in concentrations as indicated in Table I.

In carrying out the process, the aluminum was immersed in a caustic solution to remove oil and dirt from its surface, rinsed, treated with acid to remove metal salts adhering to the surface, rinsed again, and then grained. The two-stage graining process utilized three-phase 60 cycle alternating current with values for $D_1$, $D_2$, $t_1$, $t_2$, $Q_1$ and $Q_2$ as indicated in Table I. In Table I, $D_1$ and $D_2$ are in amps/dm$^2$, $t_1$ and $t_2$ are in seconds, and $Q_1$ and $Q_2$ and Q are in coulombs/dm$^2$.

The values for optical density and surface characteristics obtained in Examples 1 to 30 are reported in Table II. In Table II, the values for $R_a$, $R_z$ and $R_q$ are in micrometers.

TABLE I

| Ex. No. | $D_1$ | $D_2$ | $D_1$:$D_2$ | $t_1$ | $t_2$ | $t_1$:$t_2$ | $Q_1$ | $Q_2$ | Q | HCl g/l | $AlCl_3$ g/l | Temp. deg. C. |
|---|---|---|---|---|---|---|---|---|---|---|---|---|
| 1 | 40 | 40 | 1.0:1 | 6.8 | 33.9 | 1:4.9 | 272 | 1356 | 1628 | 11.5 | 5 | 30 |

TABLE I-continued

| Ex. No. | $D_1$ | $D_2$ | $D_1$:$D_2$ | $t_1$ | $t_2$ | $t_1$:$t_2$ | $Q_1$ | $Q_2$ | Q | HCl g/l | $AlCl_3$ g/l | Temp. deg. C. |
|---|---|---|---|---|---|---|---|---|---|---|---|---|
| 2 | 50 | 35 | 1.4:1 | 6.8 | 33.9 | 1:4.9 | 340 | 1187 | 1527 | 11.5 | 5 | 30 |
| 3 | 55 | 35 | 1.6:1 | 6.8 | 33.9 | 1:4.9 | 374 | 1187 | 1561 | 11.5 | 5 | 30 |
| 4 | 40 | 40 | 1.0:1 | 6.8 | 33.9 | 1:4.9 | 272 | 1356 | 1628 | 11.5 | 5 | 25 |
| 5 | 50 | 35 | 1.4:1 | 6.8 | 33.9 | 1:4.9 | 340 | 1187 | 1527 | 11.5 | 5 | 25 |
| 6 | 70 | 35 | 2.0:1 | 4.5 | 36.1 | 1:8.0 | 315 | 1264 | 1579 | 11.5 | 5 | 25 |
| 7 | 35 | 35 | 1.0:1 | 6.8 | 33.9 | 1:4.9 | 238 | 1187 | 1425 | 11.5 | 5 | 20 |
| 8 | 40 | 35 | 1.1:1 | 4.5 | 36.1 | 1:8.0 | 180 | 1264 | 1444 | 11.5 | 5 | 20 |
| 9 | 60 | 30 | 2.0:1 | 6.8 | 33.9 | 1:4.9 | 408 | 1017 | 1425 | 11.5 | 5 | 20 |
| 10 | 50 | 50 | 1.0:1 | 6.8 | 33.9 | 1:4.9 | 340 | 1695 | 2035 | 11.5 | 12.5 | 35 |
| 11 | 70 | 45 | 1.6:1 | 6.8 | 33.9 | 1:4.9 | 476 | 1526 | 2002 | 11.5 | 12.5 | 35 |
| 12 | 45 | 45 | 1.0:1 | 6.8 | 33.9 | 1:4.9 | 306 | 1526 | 1832 | 11.5 | 12.5 | 25 |
| 13 | 75 | 40 | 1.9:1 | 6.8 | 33.9 | 1:4.9 | 510 | 1356 | 1866 | 11.5 | 12.5 | 25 |
| 14 | 85 | 40 | 2.1:1 | 4.5 | 36.1 | 1:8.0 | 383 | 1444 | 1827 | 11.5 | 12.5 | 25 |
| 15 | 30 | 30 | 1.0:1 | 6.8 | 33.9 | 1:4.9 | 204 | 1017 | 1221 | 8 | 20 | 30 |
| 16 | 35 | 30 | 1.2:1 | 6.8 | 33.9 | 1:4.9 | 238 | 1017 | 1225 | 8 | 20 | 30 |
| 17 | 50 | 25 | 2.0:1 | 4.5 | 36.1 | 1:8.0 | 225 | 903 | 1128 | 8 | 20 | 30 |
| 18 | 23 | 23 | 1.0:1 | 6.8 | 33.9 | 1:4.9 | 156 | 780 | 936 | 8 | 5 | 35 |
| 19 | 40 | 20 | 2.0:1 | 4.5 | 36.1 | 1:8.0 | 180 | 722 | 902 | 8 | 5 | 35 |
| 20 | 35 | 20 | 1.8:1 | 6.8 | 33.9 | 1:4.9 | 238 | 678 | 916 | 8 | 5 | 35 |
| 21 | 35 | 35 | 1.0:1 | 6.8 | 33.9 | 1:4.9 | 238 | 1187 | 1425 | 9.8 | 5 | 20 |
| 22 | 45 | 30 | 1.5:1 | 6.8 | 33.9 | 1:4.9 | 306 | 1017 | 1323 | 9.8 | 5 | 20 |
| 23 | 25.5 | 15.3 | 1.7:1 | 6.1 | 30.5 | 1:5.0 | 156 | 467 | 622 | 5.5 | 21 | 46 |
| 24(1) | 60 | 30 | 2.0:1 | 6.1 | 30.5 | 1:5.0 | 366 | 915 | 1281 | 6 | 20 | 42 |
| 25(1) | 82 | 35 | 2.3:1 | 4.9 | 24.4 | 1:4.9 | 402 | 854 | 1256 | 6 | 20 | 42 |
| 26(2) | 41 | 30 | 1.4:1 | 6.1 | 30.5 | 1:5.0 | 250 | 915 | 1165 | 5 | 20 | 51 |
| 27(2) | 51 | 25 | 2.0:1 | 6.1 | 30.5 | 1:5.0 | 311 | 763 | 1074 | 5 | 20 | 47 |
| 28(3) | 51 | 30 | 1.7:1 | 6.1 | 30.5 | 1:5.0 | 311 | 915 | 1226 | 5 | 20 | 30 |
| 29(4) | 48 | 33 | 1.5:1 | 6.8 | 33.9 | 1:4.9 | 326 | 1119 | 1445 | 11.5 | 5 | 25 |
| 30(5) | 50 | 35 | 1.4:1 | 6.8 | 33.9 | 1:4.9 | 340 | 1187 | 1527 | 11.5 | 5 | 25 |

(1)Electrolyte included 8 g/l $H_3BO_3$
(2)Electrolyte included 7.5 g/l $H_3PO_4$
(3)Electrolyte included 10 g/l $H_3PO_4$
(4)3103 alloy was used
(5)5XXX alloy was used

TABLE II

| Example No. | Optical Density | $R_a$ | $R_z$ | $R_q$ | $R_q/R_a$ |
|---|---|---|---|---|---|
| 1 | 0.54 | 0.31 | 2.77 | 0.41 | 1.32 |
| 2 | 0.58 | 0.32 | 2.50 | 0.40 | 1.26 |
| 3 | 0.55 | 0.34 | 2.58 | 0.43 | 1.26 |
| 4 | 0.42 | 0.39 | 3.34 | 0.51 | 1.30 |
| 5 | 0.44 | 0.41 | 3.39 | 0.52 | 1.28 |
| 6 | 0.42 | 0.37 | 2.90 | 0.47 | 1.26 |
| 7 | 0.49 | 0.35 | 3.28 | 0.46 | 1.31 |
| 8 | 0.47 | 0.35 | 3.14 | 0.45 | 1.28 |
| 9 | 0.52 | 0.33 | 2.79 | 0.42 | 1.27 |
| 10 | 0.55 | 0.43 | 4.32 | 0.61 | 1.42 |
| 11 | 0.48 | 0.46 | 4.13 | 0.62 | 1.35 |
| 12 | 0.55 | 0.45 | 4.63 | 0.63 | 1.41 |
| 13 | 0.51 | 0.48 | 4.25 | 0.63 | 1.32 |
| 14 | 0.49 | 0.46 | 3.86 | 0.60 | 1.31 |
| 15 | 0.59 | 0.39 | 4.82 | 0.60 | 1.55 |
| 16 | 0.56 | 0.40 | 4.29 | 0.57 | 1.43 |
| 17 | 0.48 | 0.36 | 3.55 | 0.49 | 1.36 |
| 18 | 0.68 | 0.28 | 3.08 | 0.39 | 1.38 |
| 19 | 0.57 | 0.29 | 2.82 | 0.39 | 1.33 |
| 20 | 0.61 | 0.27 | 2.56 | 0.36 | 1.32 |
| 21 | 0.69 | 0.29 | 2.76 | 0.38 | 1.32 |
| 22 | 0.70 | 0.30 | 2.60 | 0.39 | 1.29 |
| 23 | 0.89 | 0.41 | — | 0.52 | 1.26 |
| 24 | 0.56 | 0.34 | — | 0.42 | 1.24 |
| 25 | 0.35 | 0.41 | — | 0.52 | 1.27 |
| 26 | 0.51 | 0.40 | — | 0.52 | 1.30 |
| 27 | 0.51 | 0.43 | — | 0.56 | 1.30 |
| 28 | 0.60 | 0.25 | — | 0.33 | 1.31 |
| 29 | 0.74 | 0.31 | 2.74 | 0.40 | 1.29 |

TABLE II-continued

| Example No. | Optical Density | $R_a$ | $R_z$ | $R_q$ | $R_q/R_a$ |
|---|---|---|---|---|---|
| 30 | 0.77 | 0.36 | 3.17 | 0.46 | 1.29 |

As indicated by the data in Table II, the two-stage process provides fine grain as indicated by $R_a$ values of less than 0.5 and very uniform grain as indicated by $R_q/R_a$ values that are typically less than 1.5 and often 1.3 or less.

Suitable procedures and compositions for preparing a lithographic printing plate from the electrolytically grained aluminum prepared in Examples 1 to 30 are described, for example, in U.S. Pat. Nos. 4,647,346, 4,865,951, and 4,983,497.

EXAMPLES 31–54

These examples were carried out in the same manner as Examples 1 to 30, except that a variable frequency power supply was utilized in stage one of the process. In each example, the electrolyte solution contained 11.5 g/l HCl and 5 g/l $AlCl_3$, the temperature was 25° C., $t_1$ was 6.8 seconds and $t_2$ was 33.9 seconds. The results obtained are reported in Table III. In Table III, frequency is in cycles/second. $D_1$ and $D_2$ are in amps/dm$^2$, $Q_1$, $Q_2$ and Q are in coulombs/dm$^2$, and $R_a$, $R_z$ and $R_q$ are in micrometers.

TABLE III

| Ex. No. | Frequency | $D_1$ | $D_2$ | $D_1$:$D_2$ | $Q_1$ | $Q_2$ | Q | $R_a$ | $R_z$ | $R_q$ | $R_q/R_a$ |
|---|---|---|---|---|---|---|---|---|---|---|---|
| 31 | 60 | 50 | 35 | 1.43:1 | 340 | 1187 | 1527 | 0.33 | 2.74 | 0.42 | 1.27 |
| 32 | 120 | 50 | 35 | 1.43:1 | 340 | 1187 | 1527 | 0.33 | 2.71 | 0.42 | 1.27 |
| 33 | 180 | 50 | 35 | 1.43:1 | 340 | 1187 | 1527 | 0.33 | 2.67 | 0.42 | 1.27 |
| 34 | 240 | 50 | 35 | 1.43:1 | 340 | 1187 | 1527 | 0.31 | 2.57 | 0.40 | 1.29 |
| 35 | 300 | 50 | 35 | 1.43:1 | 340 | 1187 | 1527 | 0.31 | 2.48 | 0.40 | 1.29 |

TABLE III-continued

| Ex. No. | Frequency | $D_1$ | $D_2$ | $D_1$:$D_2$ | $Q_1$ | $Q_2$ | Q | $R_a$ | $R_z$ | $R_q$ | $R_q/R_a$ |
|---|---|---|---|---|---|---|---|---|---|---|---|
| 36 | 360 | 50 | 35 | 1.43:1 | 340 | 1187 | 1527 | 0.32 | 2.55 | 0.41 | 1.26 |
| 37 | 360 | 50 | 39 | 1.28:1 | 340 | 1322 | 1662 | 0.35 | 2.98 | 0.44 | 1.26 |
| 38 | 300 | 50 | 39 | 1.43:1 | 340 | 1322 | 1662 | 0.34 | 2.73 | 0.43 | 1.26 |
| 39 | 240 | 50 | 39 | 1.28:1 | 340 | 1322 | 1662 | 0.33 | 2.65 | 0.42 | 1.27 |
| 40 | 180 | 50 | 39 | 1.28:1 | 340 | 1322 | 1662 | 0.35 | 2.78 | 0.44 | 1.26 |
| 41 | 120 | 50 | 39 | 1.28:1 | 340 | 1322 | 1662 | 0.36 | 2.76 | 0.45 | 1.25 |
| 42 | 60 | 50 | 39 | 1.28:1 | 340 | 1322 | 1662 | 0.36 | 2.70 | 0.45 | 1.25 |
| 43 | 60 | 86 | 35 | 2.46:1 | 585 | 1186 | 1771 | 0.72 | 5.98 | 0.99 | 1.37 |
| 44 | 120 | 86 | 35 | 2.46:1 | 585 | 1186 | 1771 | 0.65 | 4.58 | 0.82 | 1.26 |
| 45 | 180 | 86 | 35 | 2.46:1 | 585 | 1186 | 1771 | 0.59 | 3.97 | 0.73 | 1.24 |
| 46 | 240 | 86 | 35 | 2.46:1 | 585 | 1186 | 1771 | 0.53 | 3.61 | 0.65 | 1.23 |
| 47 | 300 | 86 | 35 | 2.46:1 | 585 | 1186 | 1771 | 0.47 | 3.36 | 0.59 | 1.26 |
| 48 | 360 | 86 | 35 | 2.46:1 | 585 | 1186 | 1771 | 0.41 | 3.09 | 0.52 | 1.27 |
| 49 | 360 | 86 | 27 | 3.19:1 | 585 | 915 | 1500 | 0.35 | 2.69 | 0.44 | 1.26 |
| 50 | 300 | 86 | 27 | 3.19:1 | 585 | 915 | 1500 | 0.40 | 2.86 | 0.50 | 1.25 |
| 51 | 240 | 86 | 27 | 3.19:1 | 585 | 915 | 1500 | 0.41 | 2.98 | 0.51 | 1.24 |
| 52 | 180 | 86 | 27 | 3.19:1 | 585 | 915 | 1500 | 0.45 | 3.30 | 0.57 | 1.27 |
| 53 | 120 | 86 | 27 | 3.19:1 | 585 | 915 | 1500 | 0.49 | 3.89 | 0.64 | 1.31 |
| 54 | 60 | 86 | 27 | 3.19:1 | 585 | 915 | 1500 | 0.48 | 4.44 | 0.67 | 1.40 |

As indicated by the data reported in Table III, good results were obtained under all of the conditions evaluated. Use of a frequency higher than standard fifty or sixty cycle is not necessary in this invention, but higher frequencies can provide improved uniformity in grain structure when very high current densities are employed and very high current densities permit the use of short treatment times and thereby facilitate the achievement of high throughput.

The two-stage process described herein typically provides $R_a$ values of less than about 0.7 and frequently of less than 0.5 . A value of less than 0.5 for $R_a$ is indicative of very fine grain structure. It also typically provides low $R_q/R_a$ values of less than about 1.5, which is indicative of uniform grain formation. A desired very high degree of uniformity of grain structure, which provides optimum performance in lithographic printing plates, is achieved when the $R_q/R_a$ value is equal to or less than 1.3.

The two-stage process described herein provides many important advantages as compared to prior processes for electrolytic graining of aluminum. In particular, a very fine grain structure and very large surface area can be obtained which provides excellent adhesion for radiation-sensitive coatings that are subsequently applied and good resolution during the printing process. The uniformity of the grain structure is outstanding. In contrast with results obtained in prior art electrolytic graining processes, the grain structure is non-directional in nature. A grained surface having a low smut level is produced, and the smut is only loosely bound and easily removed, thereby requiring less etching and reducing the chance that the grain structure will be adversely affected by a harsh etching process. The three-dimensional grain structure that is produced by the two-stage process is capable of creating an optimum ink/water balance, as desired for high quality printing. The two-stage graining process also provides good power efficiency and low chemical consumption, yet attains the grain morphology that is critical to the lithographic printing process. These many advantageous features provided by the graining process cooperate to provide a surface that contributes to good press wear and operating latitude.

While the novel two-stage process described herein is especially beneficial for the graining of aluminum sheet material used as a support for lithographic printing plates, and has been described herein with particular reference to such utility, it can be used for the graining of any aluminum article, regardless of its size, shape or purpose, whenever it is desired to provide a surface with a fine uniform grain. For example, the process is beneficial in the production of decorative architectural aluminum and in the production of aluminum foil for electrolytic capacitors.

The invention has been described in detail with particular reference to preferred embodiments thereof, but it will be understood that variations and modifications can be effected within the spirit and scope of the invention.

I claim:

1. A lithographic printing plate comprising a grained support, composed of aluminum or an alloy thereof, having thereon at least one radiation-sensitive layer capable of forming a lithographic printing surface; said support having been electrolytically grained in a two-stage process to achieve a fine uniform grain that is essentially free of pits; in which process said support is immersed in an acidic electrolyte solution while it is subjected to an electric current in successive first and second stages of said process and the application of said electric current is controlled so that $D_1$:$D_2$ is in the range of from about 1:1 to about 7:1, $t_1$:$t_2$ is in the range of from about 1:2 to about 1:15, $Q_1$ is less than $Q_2$, and the total current consumption is in the range of from about 200 to about 5,000 coulombs/dm$^2$; wherein $D_1$ and $D_2$ respectively represent current density in amps/dm$^2$ in said first and second stages, $t_1$ and $t_2$ respectively represent treatment time in seconds in said first and second stages, and $Q_1$ and $Q_2$ respectively represent current consumption in coulombs/dm$^2$ in said first and second stages.

2. A lithographic printing plate as claimed in claim 1 wherein $D_1$:$D_2$ is in the range of from about 1.2:1 to about 5:1.

3. A lithographic printing plate as claimed in claim 1 wherein $D_1$:$D_2$ is in the range of from about 2:1 to about 4:1.

4. A lithographic printing plate as claimed in claim 1 wherein $t_1$:$t_2$ is in the range of from about 1:3 to about 1:10.

5. A lithographic printing plate as claimed in claim 1 wherein $t_1$:$t_2$ is in the range of from about 1:4 to about 1:8.

6. A lithographic printing plate as claimed in claim 1 wherein total current consumption is in the range of from about 1,000 to about 3,000 coulombs/$dm^2$.

7. A lithographic printing plate as claimed in claim 1 wherein the current density in said first stage is in the range of from about 50 to about 100 amps/$dm^2$.

8. A lithographic printing plate as claimed in claim 1 wherein the current density in said first stage is in the range of from about 15 to about 40 amps/$dm^2$.

9. A lithographic printing plate as claimed in claim 1 wherein said electrolyte solution comprises hydrochloric acid and aluminum chloride.

10. A lithographic printing plate as claimed in claim 9 wherein the temperature of said electrolyte solution is maintained in the range of from about 10° C. to about 75° C.

11. A lithographic printing plate as claimed in claim 9 wherein the temperature of said electrolyte solution is maintained in the range of from about 20° C. to about 50° C.

12. A lithographic printing plate as claimed in claim 9 wherein said electrolyte solution contains about 5 to about 15 grams per liter of hydrochloric acid.

13. A lithographic printing plate as claimed in claim 9 wherein said electrolyte solution contains about 4 to about 25 grams per liter of aluminum chloride.

14. A lithographic printing plate as claimed in claim 9 wherein said electrolyte solution additionally contains boric acid.

15. A lithographic printing plate as claimed in claim 9 wherein said electrolyte solution additionally contains phosphoric acid.

16. A lithographic printing plate as claimed in claim 1 wherein the electric current utilized is alternating electric current.

17. A lithographic printing plate comprising a grained and anodized support, composed of aluminum or an alloy thereof, having thereon at least one radiation-sensitive layer capable of forming a lithographic printing surface, said support having been electrolytically grained in a two-stage process to achieve a fine uniform grain that is essentially free of pits; in which process said support is immersed in an acidic electrolyte solution comprised of hydrochloric acid and aluminum chloride while it is subjected to an alternating electric current in successive first and second stages of said process and the application of said alternating electric current is controlled so that $D_1$:$D_2$ is in the range of from about 1.2:1 to about 5:1, $t_1$:$t_2$ is in the range of from about 1:3 to about 1:10, $Q_1$ is less than $Q_2$, and the total current consumption is in the range of from about 1,000 to about 3,000 coulombs/$dm^2$; wherein $D_1$ and $D_2$ respectively represent current density in amps/$dm^2$ in said first and second stages, $t_1$ and $t_2$ respectively represent treatment time in seconds in said first and second stages, and $Q_1$ and $Q_2$ respectively represent current consumption in coulombs/$dm^2$ in said first and second stages.

18. A lithographic printing plate comprising a grained and anodized support, composed of aluminum or an alloy thereof, having thereon at least one radiation-sensitive layer capable of forming a lithographic printing surface, said support having been electrolytically grained in a two-stage process to achieve a fine uniform grain that is essentially free of pits; in which process said support is immersed in an acidic electrolytic solution comprised of hydrochloric acid and aluminum chloride while it is subjected to an alternating electric current in successive first and second stages of said process and the application of said alternating electric current is controlled so that $D_1$:$D_2$ is in the range of from about 2:1 to about 4:1, $t_1$:$t_2$ is in the range of from about 1:4 to about 1:8, $Q_1$ is less than $Q_2$, and the total current consumption is in the range of from about 1,000 to about 3,000 coulombs/$dm^2$; wherein $D_1$ and $D_2$ respectively represent current density in amps/$dm^2$ in said first and second stages, $t_1$ and $t_2$ respectively represent treatment time in seconds in said first and second stages, and $Q_1$ and $Q_2$ respectively represent current consumption in coulombs/$dm^2$ in said first and second stages.

19. A lithographic printing plate as claimed in claim 17 wherein said electrolytically grained aluminum support has been anodized in a sulfuric acid solution.

20. A lithographic printing plate as claimed in claim 17 wherein said electrolytically grained average, $R_a$, of less than 0.5.

21. A lithographic printing plate as claimed in claim 17 wherein said electrolytically grained aluminum support has an $R_q/R_a$ value of 1.3 or less wherein $R_q$ is the root-mean-square roughness and $R_a$ is the roughness average.

22. A lithographic printing plate as claimed in claim 1 wherein said plate is negative-working.

23. A lithographic printing plate as claimed in claim 1 wherein said plate is positive-working.

24. A lithographic printing plate as claimed in claim 1 including a radiation-sensitive layer comprising a diazo resin and a polymeric binder.

25. A lithographic printing plate as claimed in claim 1 including a radiation-sensitive layer comprising a photocrosslinkable polymer.

26. A lithographic printing plate as claimed in claim 1 comprising a first radiation-sensitive layer comprising a diazo resin and a polymeric binder and a second radiation-sensitive layer comprising a photocrosslinkable polymer.

* * * * *